US011408583B1

(12) United States Patent
Wang

(10) Patent No.: US 11,408,583 B1
(45) Date of Patent: Aug. 9, 2022

(54) LED LIGHT FIXTURE

(71) Applicant: Tiejun Wang, Lin'an (CN)

(72) Inventor: Tiejun Wang, Lin'an (CN)

( * ) Notice: Subject to any disclaimer, the term of this patent is extended or adjusted under 35 U.S.C. 154(b) by 0 days.

(21) Appl. No.: 17/396,850

(22) Filed: Aug. 9, 2021

(51) Int. Cl.

| | |
|---|---|
| ***F21V 3/04*** | (2018.01) |
| ***F21V 23/04*** | (2006.01) |
| *F21Y 113/10* | (2016.01) |
| *F21Y 115/10* | (2016.01) |

(52) U.S. Cl.
CPC ..... *F21V 3/04* (2013.01); *F21V 23/04* (2013.01); *F21Y 2113/10* (2016.08); *F21Y 2115/10* (2016.08)

(58) Field of Classification Search
CPC ..... F21V 3/04; F21V 23/04
See application file for complete search history.

(56) References Cited

U.S. PATENT DOCUMENTS 10,619,822 B1* 4/2020 Hsu ..... F21V 3/04
2010/0208473 A1* 8/2010 Sakai ..... F21V 29/83 362/373
2010/0328939 A1* 12/2010 Chen ..... F21S 8/06 362/235
2011/0267810 A1* 11/2011 Higman ..... F21V 23/026 362/218
2012/0113633 A1* 5/2012 Bowen ..... F21V 23/005 362/235
2012/0275154 A1* 11/2012 Hood ..... F21V 31/005 362/249.02
2013/0077313 A1* 3/2013 Chen ..... H05K 1/0209 362/249.02
2013/0250579 A1* 9/2013 Athalye ..... F21S 8/026 362/296.05
2015/0338084 A1* 11/2015 Ryder ..... F21V 3/04 362/606
2016/0377245 A1* 12/2016 Yaphe ..... F21V 21/048 362/147
2017/0191637 A1* 7/2017 Gommans ..... F21V 5/008
2019/0212003 A1* 7/2019 Lazear ..... F21V 21/30

* cited by examiner

*Primary Examiner* — Bryon T Gyllstrom
*Assistant Examiner* — Christopher E Dunay
(74) *Attorney, Agent, or Firm* — Daniel M. Cohn; Howard M. Cohn

(57) ABSTRACT

Disclosed embodiments provide a light emitting diode (LED) light fixture that comprises an LED light module. Multiple LEDs are arranged in a first series connection on a circuit board. A first power lead is configured and disposed as a positive power source connection. Aa second power lead is configured and disposed as a negative power source connection. The LEDs are densely arranged on the circuit board such that the LEDs have an average linear interspacing and an average lateral interspacing that enable high-density lighting. Disclosed embodiments provide a significant amount of light in a small, portable package. Embodiments include a rimless light cover to further increase the amount of light emanating from the light fixture.

19 Claims, 17 Drawing Sheets

LED LIGHT FIXTURE

FIELD

The present invention relates generally to lighting, and more particularly to a LED light module.

BACKGROUND

Light Emitting Diode (LED) lighting is currently available in a wide variety of home and industrial products. The rapid development of LED technology leads to more products and improved manufacturing efficiency, which also results in lower prices. The reduced power requirements as compared with incandescent lighting enables portable lighting applications such as flashlights, vehicle lights, and more. It is therefore desirable to have improvements in the field of LED lighting.

SUMMARY

In one embodiment, there is provided light fixture comprising a light module, the light module comprising: a plurality of light emitting diodes (LEDs) arranged in a first series connection on a circuit board; a light source housing, configured and disposed to contain the circuit board; a plurality of clips disposed on the light source housing; an adapter ring, configured and disposed to engage the plurality of clips; and a rimless cover, configured and disposed to attach to the light source housing.

In another embodiment, there is provided an illumination system comprising: an enclosure; a light module disposed within the enclosure, the light module comprising: a plurality of light emitting diodes (LEDs) arranged in a first series connection on a circuit board; a first power lead configured and disposed as a positive power source connection, and; a second power lead configured and disposed as a negative power source connection; wherein the LEDs are positioned on the circuit board to have an average linear interspacing ranging from 6 millimeters to 20 millimeters and an average lateral interspacing ranging from 6 millimeters to 20 millimeters; a power source coupled to the light module; a switch configured and disposed to connect the light module to the power source; and a rimless cover, configured and disposed to attach to the enclosure.

BRIEF DESCRIPTION OF THE DRAWINGS

The structure, operation, and advantages of the present invention will become further apparent upon consideration of the following description taken in conjunction with the accompanying figures (FIGs). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 1:
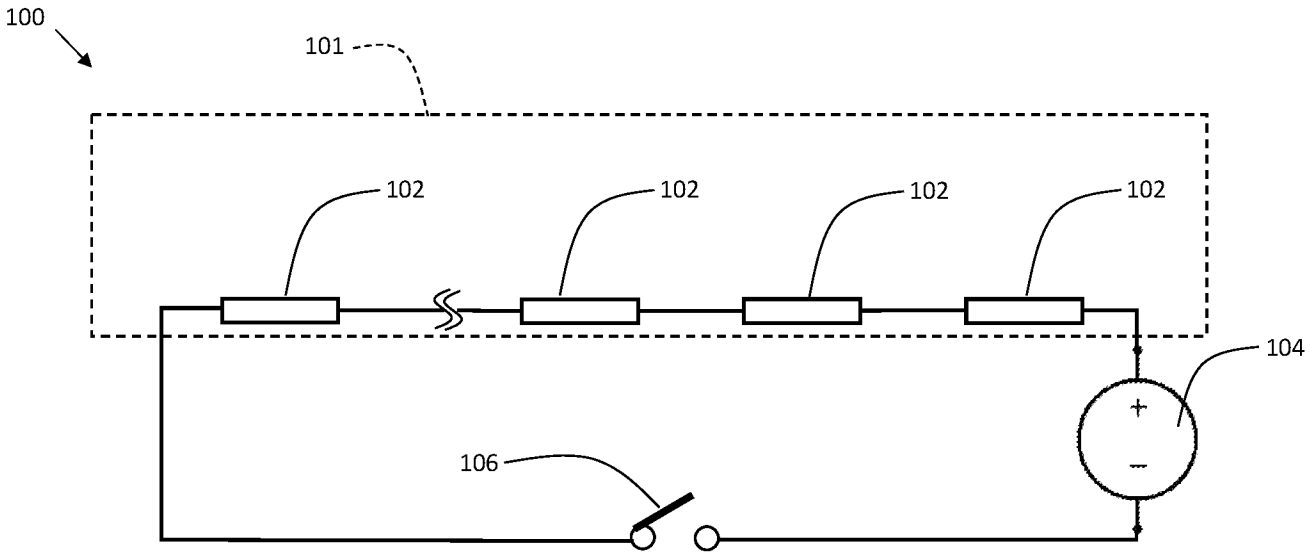

Often, similar elements may be referred to by similar numbers in various figures (FIGs) of the drawing, in which case typically the last two significant digits may be the same, the most significant digit being the number of the drawing figure (FIG). Furthermore, for clarity, some reference numbers may be omitted in certain drawings.

FIG. 1 shows a schematic view of a light module in accordance with embodiments of the present invention.

Figure 2:
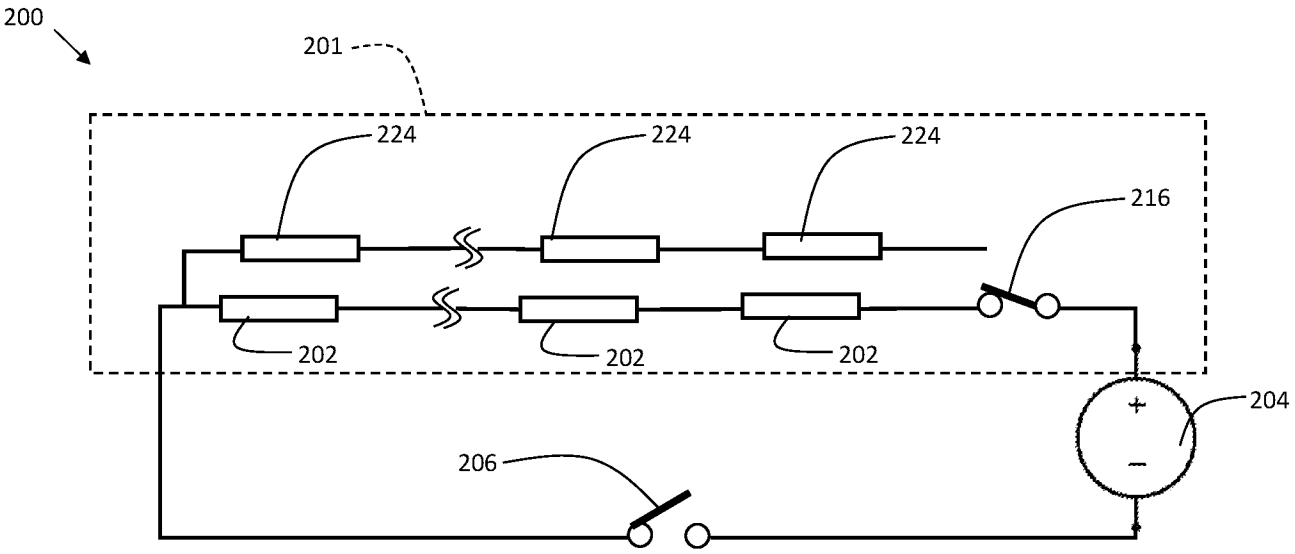

FIG. 2 shows a schematic view of a light module in accordance with additional embodiments of the present invention.

Figure 3:
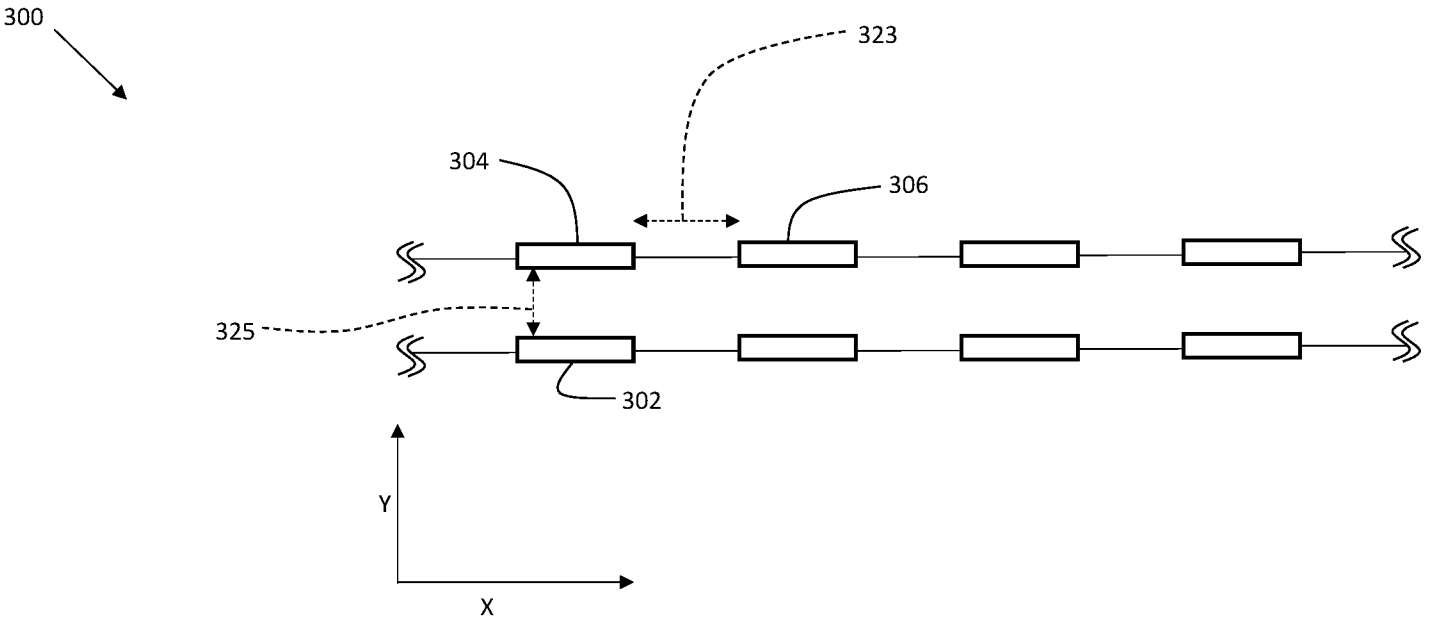

FIG. 3 is a detailed schematic view of a light module indicating linear interspacing and lateral interspacing.

Figure 4:
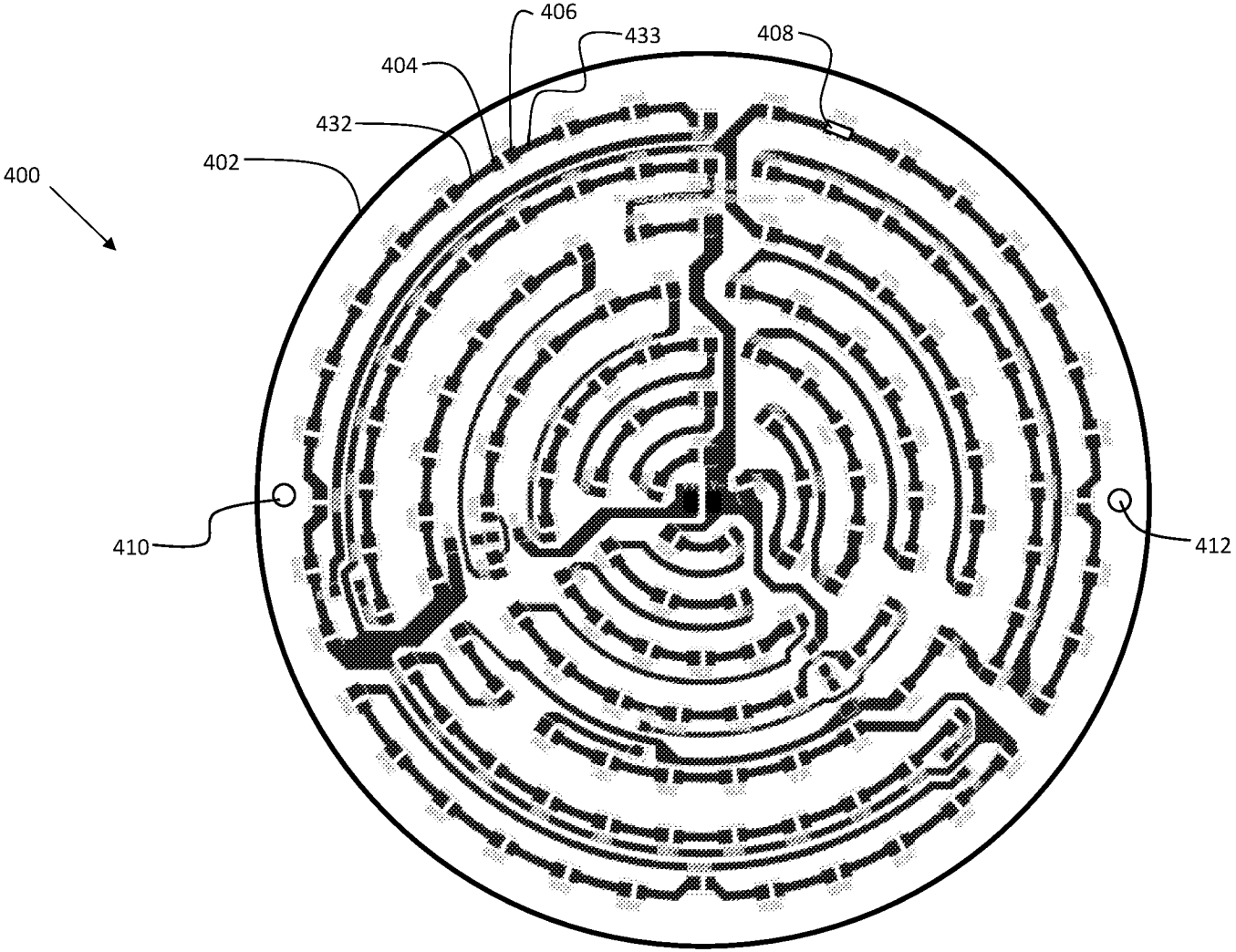

FIG. 4 is an embodiment of the present invention utilizing a circuit board formed in a circular shape.

Figure 5:
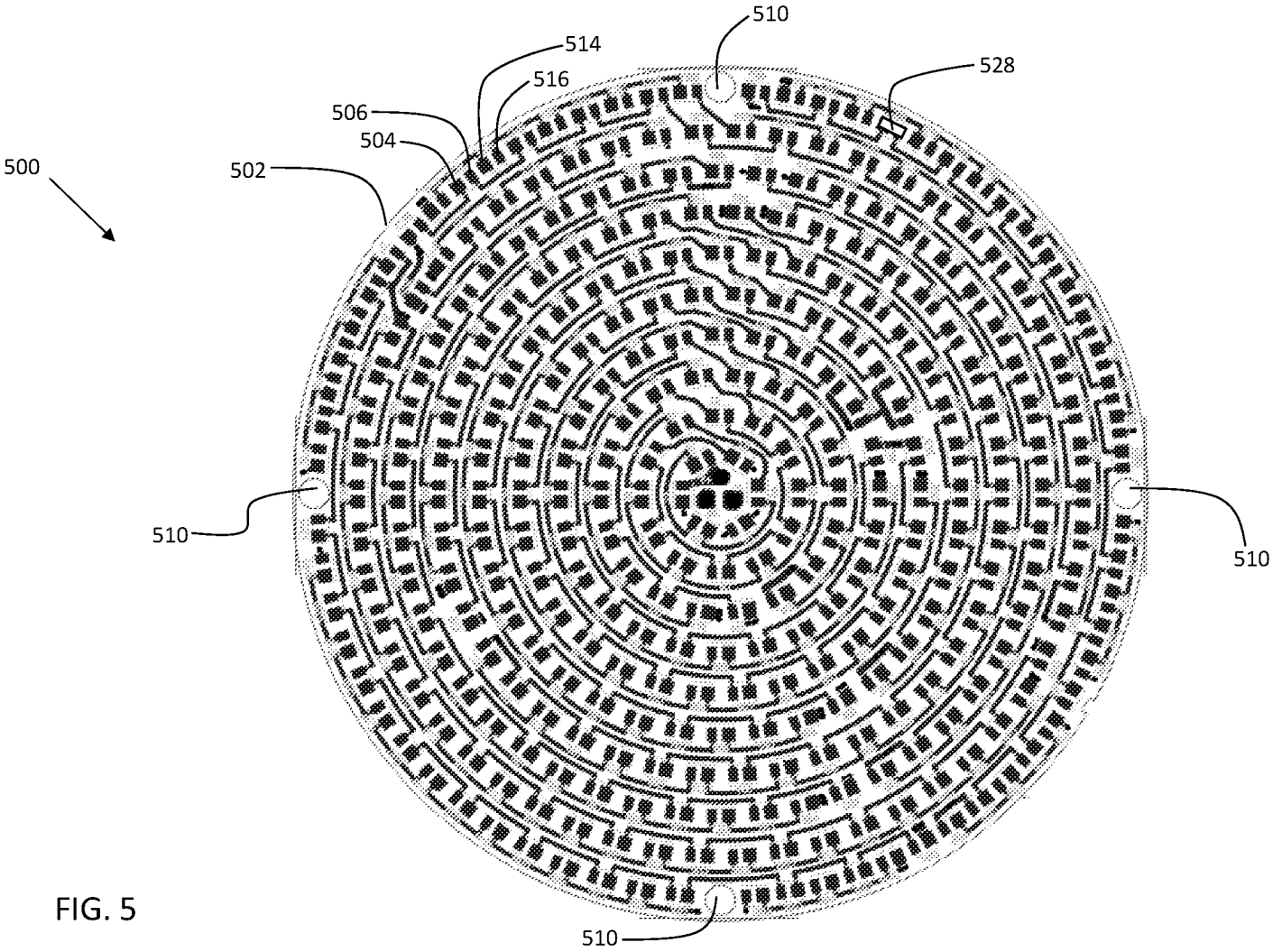

FIG. 5 is an additional embodiment of the present invention utilizing a circuit board formed in a circular shape.

Figure 6:
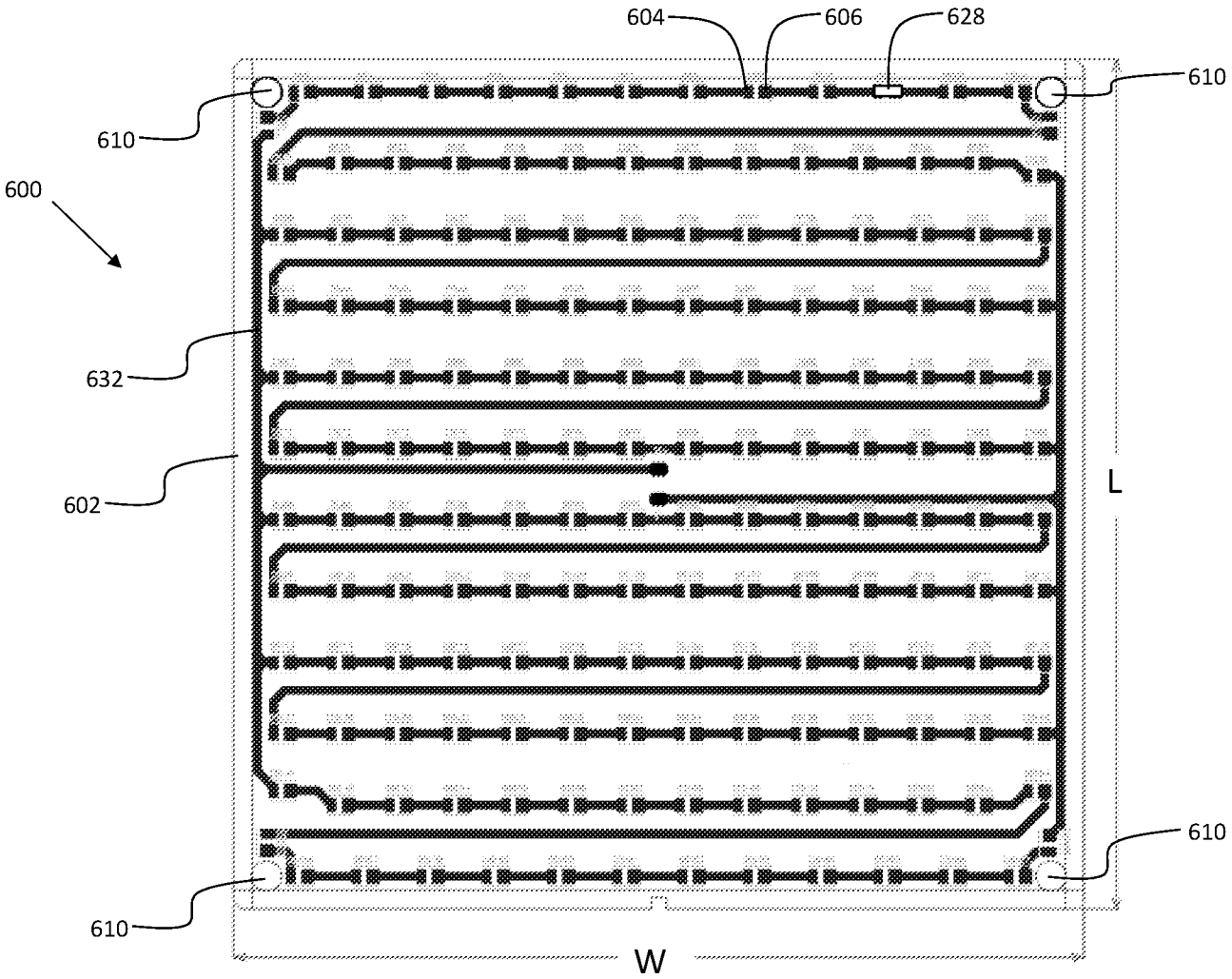

FIG. 6 is an embodiment of the present invention utilizing a circuit board formed in a rectangular shape.

Figure 7:
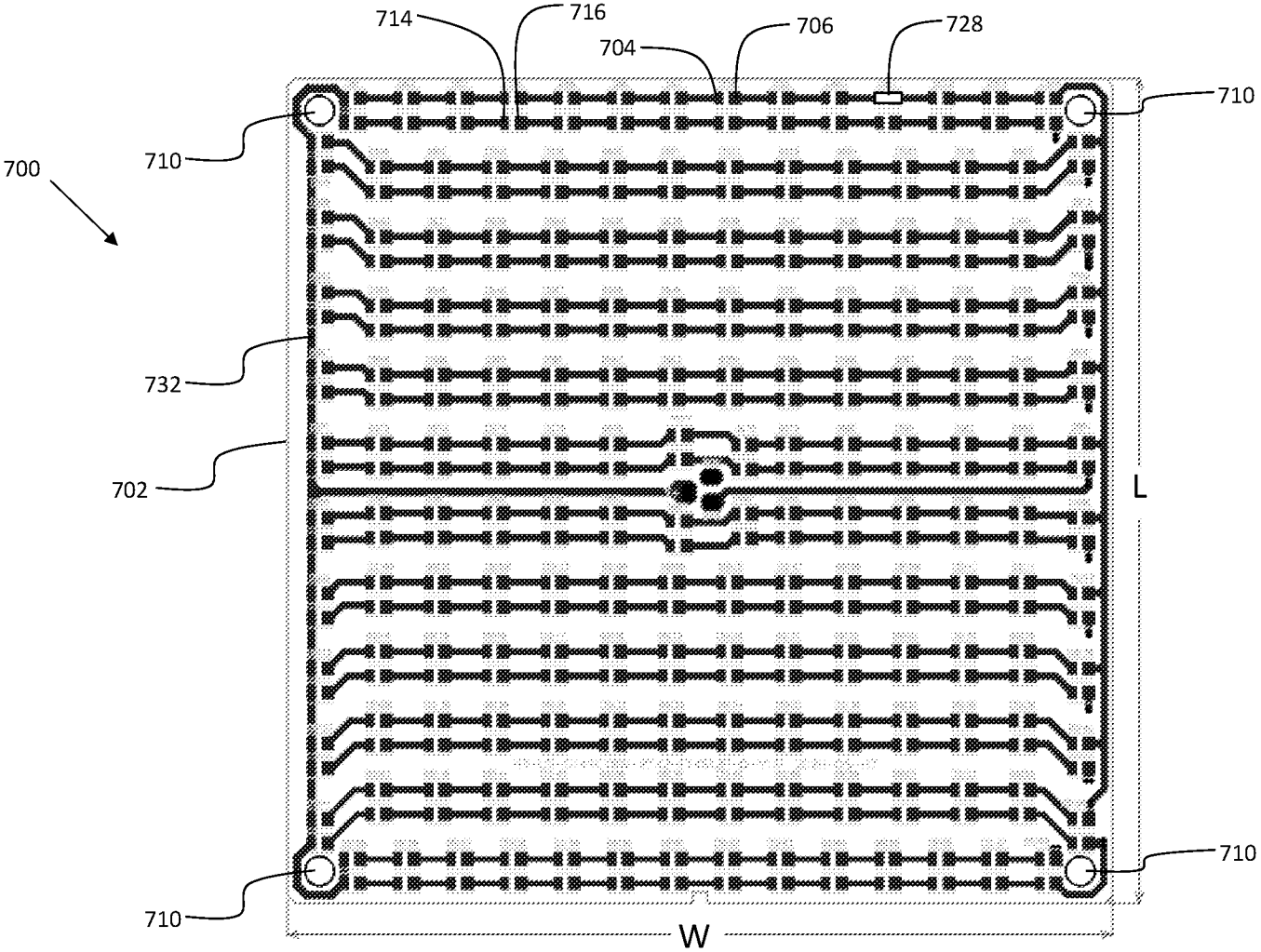

FIG. 7 is an additional embodiment of the present invention utilizing a circuit board formed in a rectangular shape.

Figure 8:
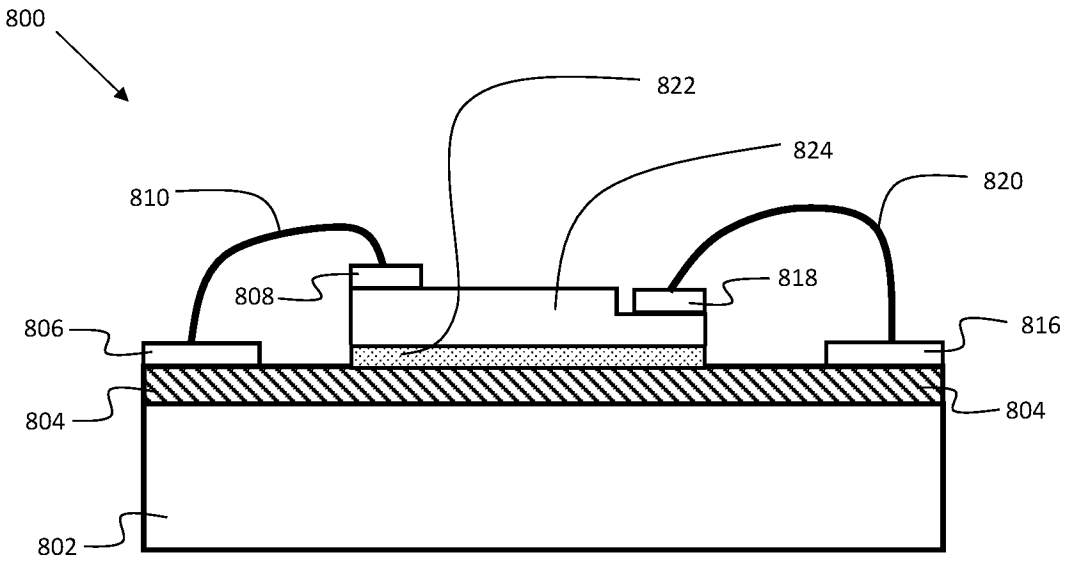

FIG. 8 shows details of a wire bonded LED used in accordance with embodiments of the present invention.

Figure 9:
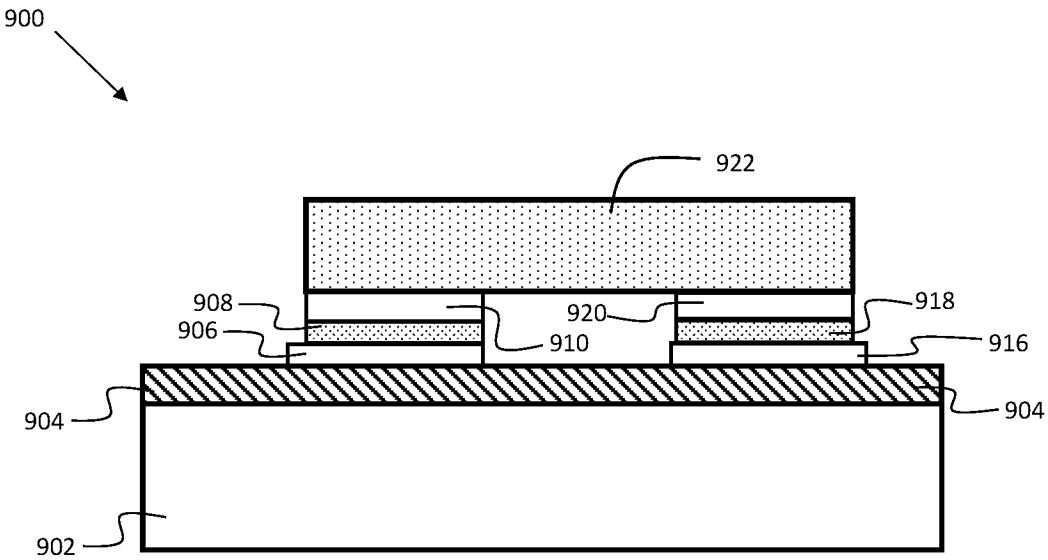

FIG. 9 shows details of a flip chip LED used in accordance with embodiments of the present invention.

Figure 10:
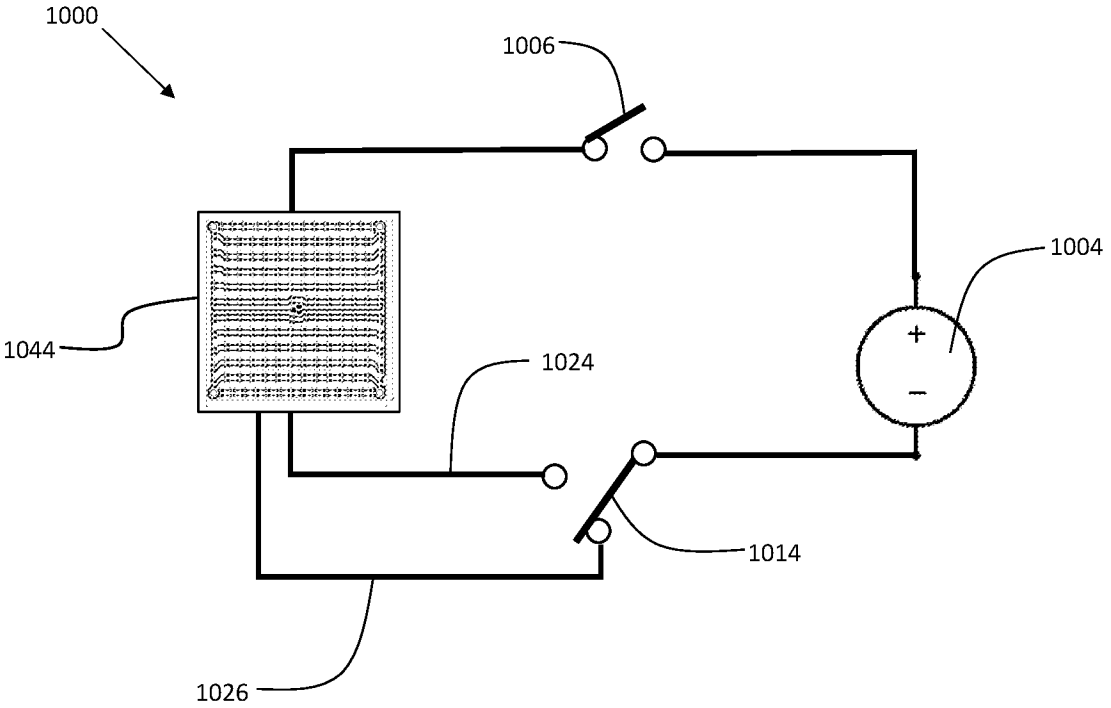

FIG. 10 shows an exemplary circuit for a dual-color light module in accordance with embodiments of the present invention.

Figure 11:
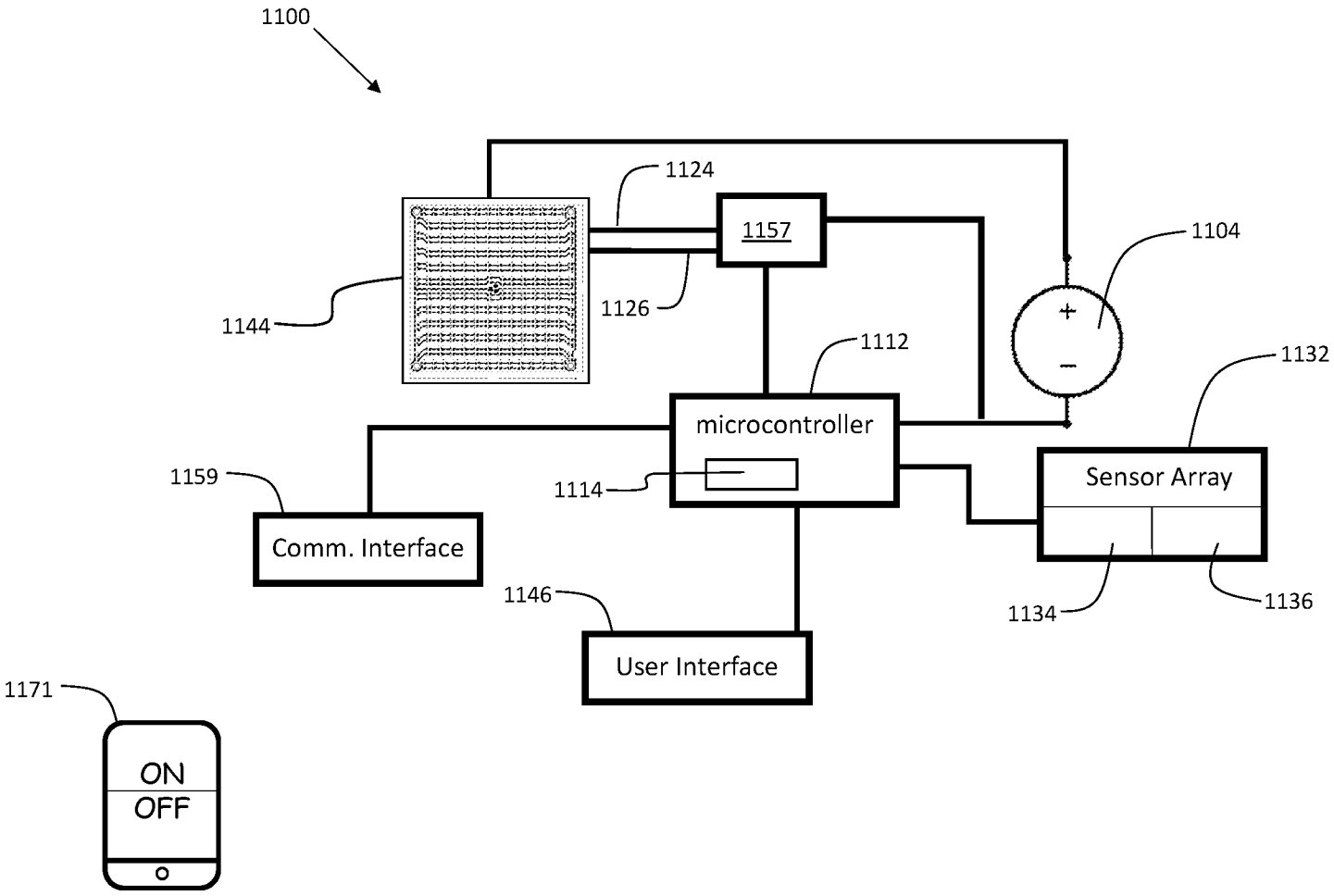

FIG. 11 shows an exemplary microprocessor-controlled circuit for a dual-color light module in accordance with embodiments of the present invention.

Figure 12:
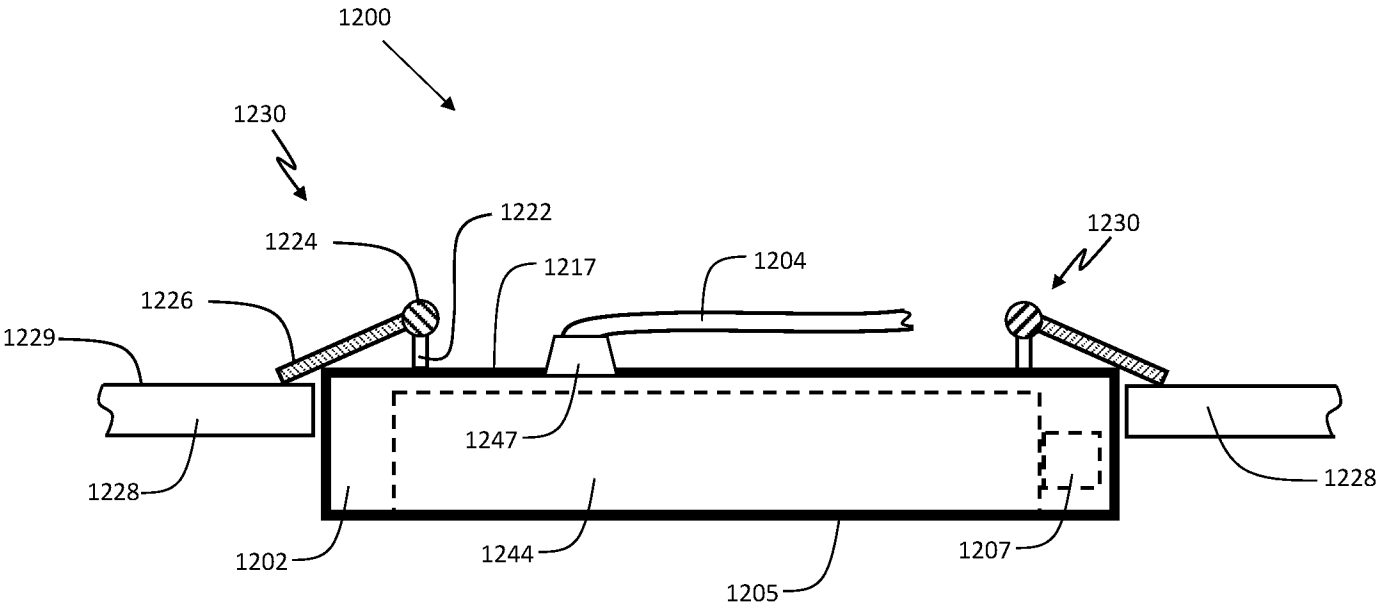

FIG. 12 shows an exemplary light fixture utilizing a light module in accordance with embodiments of the present invention.

Figure 13:
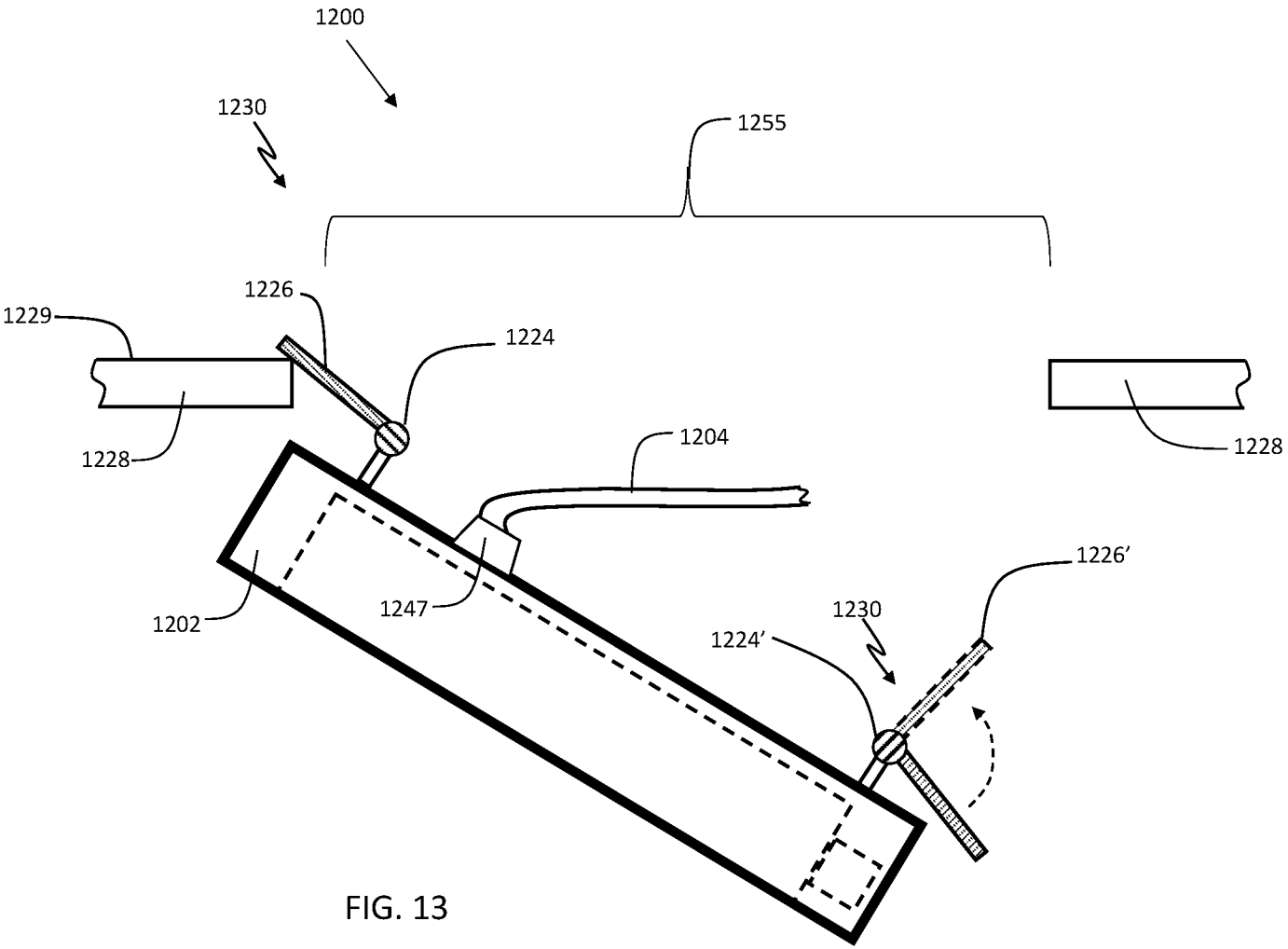

FIG. 13 shows installation of an LED light fixture in accordance with embodiments of the present invention.

Figure 14:
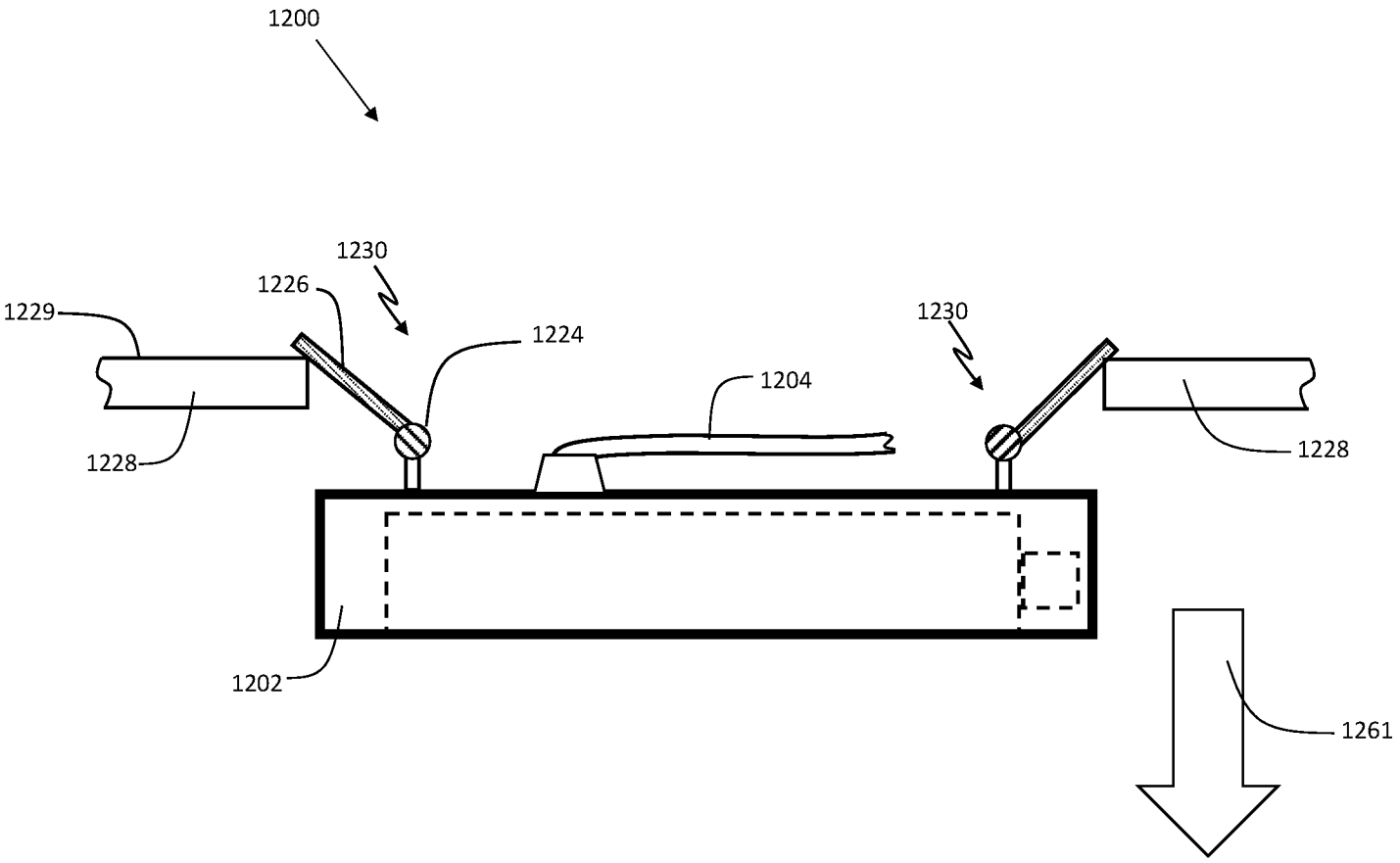

FIG. 14 shows removal of an LED light fixture in accordance with embodiments of the present invention.

Figure 15B:
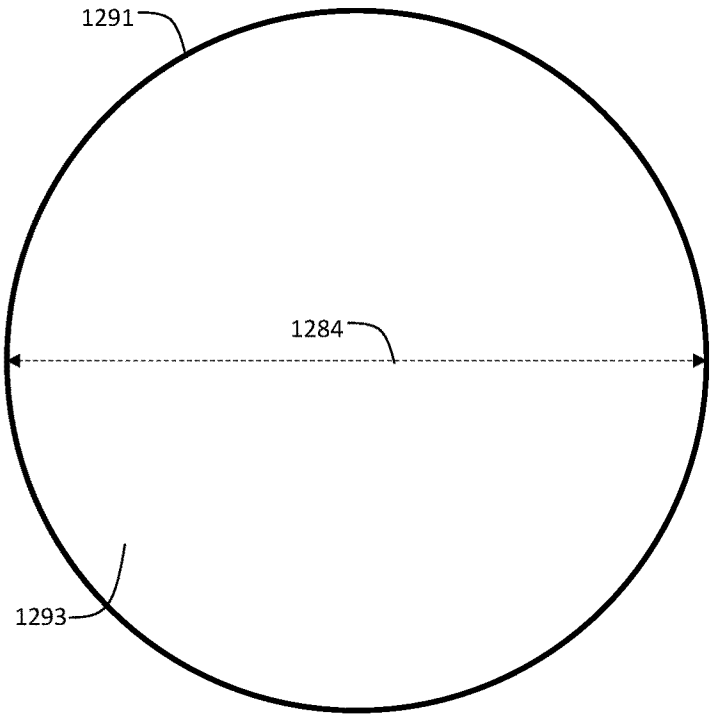
Figure 15A:
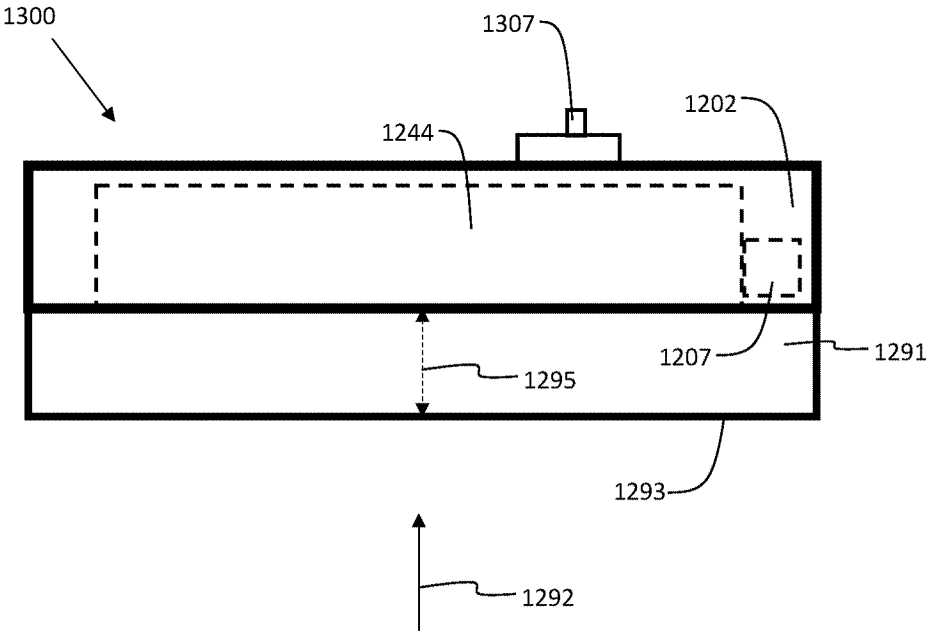

FIG. 15A shows a side view of an additional embodiment of the present invention.

FIG. 15B shows a bottom-up view of the embodiment of FIG. 15A.

Figure 16:
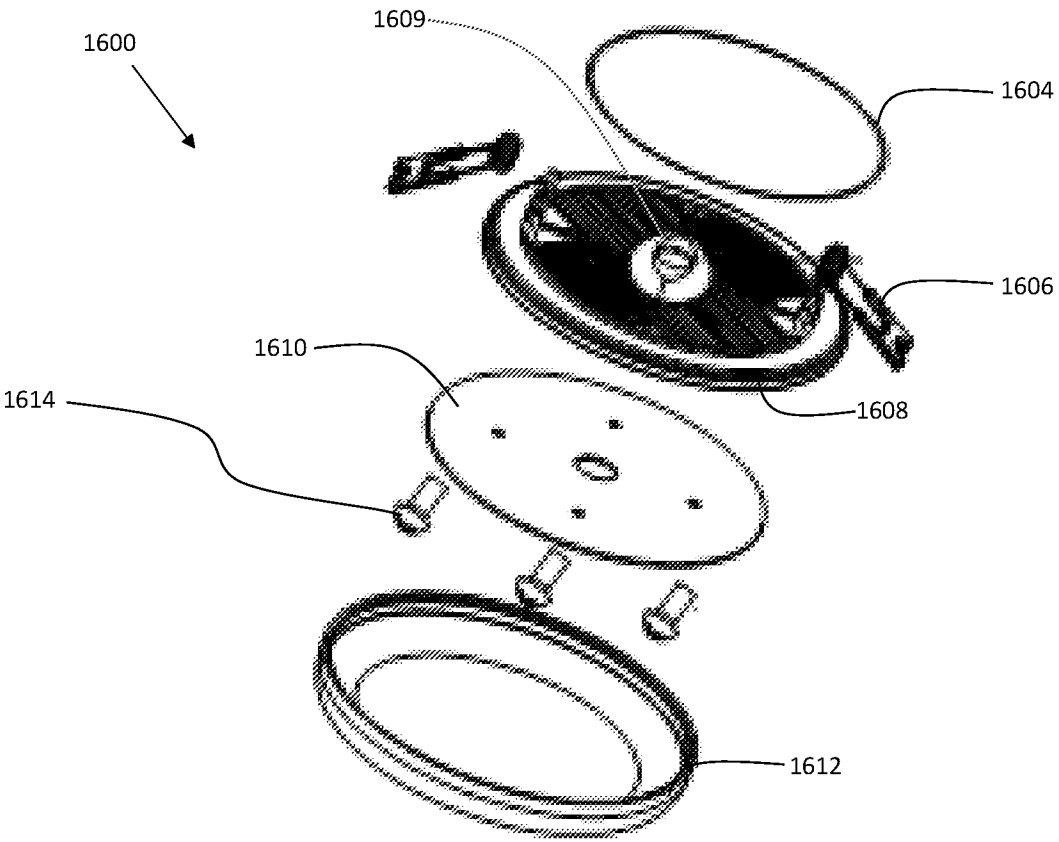

FIG. 16 shows an exploded view of a rimless round LED light fixture.

Figure 17:
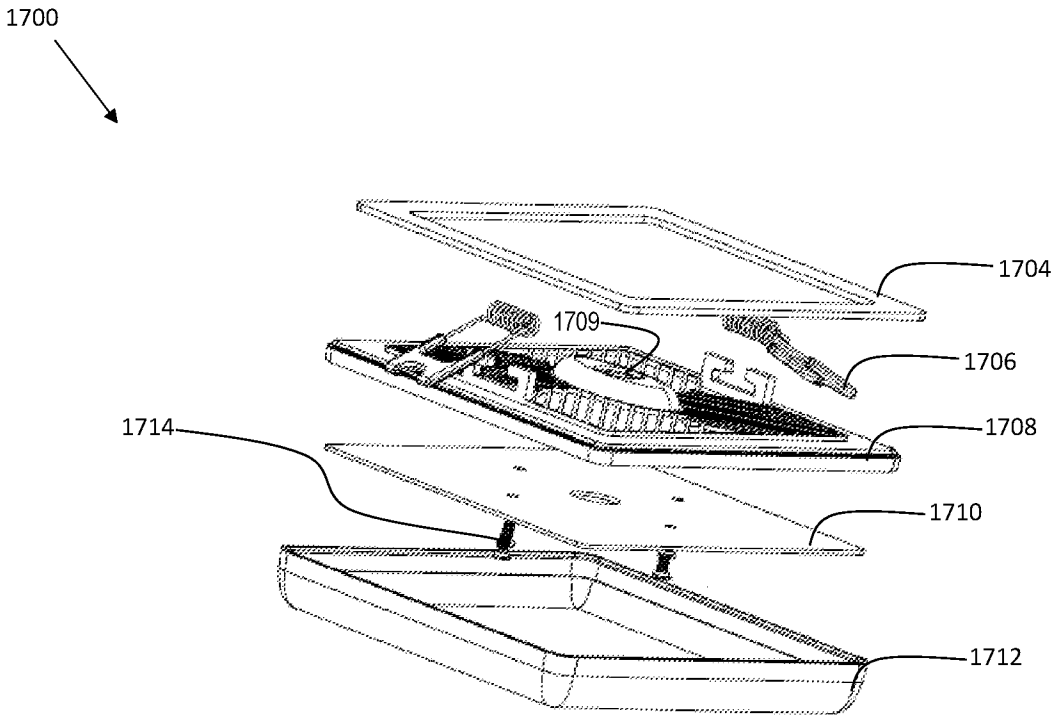

FIG. 17 shows an exploded view of a rimless rectangular LED light fixture.

DETAILED DESCRIPTION

Disclosed embodiments provide a light emitting diode (LED) light fixture utilizing an LED light module. Multiple LEDs are arranged in a first series connection on a circuit board. A first power lead is configured and disposed as a positive power source connection. Aa second power lead is configured and disposed as a negative power source connection. The interspacing refers to the distance between an LED and a neighboring LED on a circuit board. In embodiments, the LEDs are positioned on the circuit board such that the LEDs have an average linear interspacing ranging from 6 millimeters to 20 millimeters and an average lateral interspacing ranging from 6 millimeters to 20 millimeters. Some embodiments may have an average linear interspacing ranging from 1 millimeter to 4 millimeters. Some embodiments may have an average lateral interspacing ranging from 1 millimeter to 4 millimeters. Disclosed embodiments provide a significant amount of light in a small, portable package. Some embodiments may include multiple sets of LEDs, where each set of LEDs illuminates in a different color. In this way, some embodiments are capable of illuminating in various colors. Some embodiments may include red LEDs (emitting a light wavelength ranging from 635 nanometers to 700 nanometers), orange LEDs (emitting a light wavelength ranging from 590 nanometers to 699 nanometers), yellow LEDs (emitting a light wavelength ranging from 560 nanometers to 589 nanometers), and/or blue LEDs (emitting a light wavelength ranging from 450 nanometers to 489 nanometers). Other colors and/or combinations of colors are possible in disclosed embodiments (CCT from 1800K to 70000K). In some embodiments, the light from multiple LEDs may be combined to produce other colors, such as white, with varying correlated color temperature (CCT). The small size and reduced power requirements of disclosed embodiments make them well suited for applications such as recessed interior lighting, or partially recessed interior lighting.

FIG. 1 shows a schematic view of an illumination system 100 utilizing a light module 101 in accordance with embodiments of the present invention. The light module 101 includes multiple LEDs, indicated generally as 102, arranged in an electrical series connection. While four LEDs are shown in FIG. 1, in practice, there can be many more LEDs (e.g. hundreds, or even thousands) in some embodiments. The LEDs 102 are powered by a power source 104. In embodiments, the power source 104 may include one or more batteries. In portable applications, the power source 104 may include one or more small batteries such as AA or AAA sized batteries. In some embodiments, the power source 104 may include one or more coin-style batteries such as a CR2032 or similar battery type. In some embodiments, the power source 104 may be a rechargeable power source. In some embodiments, the power source 104 may be a wired AC or DC power source. A switch 106 may be used to complete the circuit which allows the LEDs to illuminate.

FIG. 2 shows a schematic view of an illumination system 200 utilizing a light module 201 in accordance with additional embodiments of the present invention. Light module 201 includes a first set of LEDs, indicated generally as 202, arranged in a first electrical series connection. Light module 201 includes a second set of LEDs, indicated generally as 224, arranged in a second electrical series connection. In some embodiments, the first set of LEDs 202 may illuminate in a first color, and the second set of LEDs 224 may illuminate in a second color. As a non-limiting example, the first set of LEDs 202 may illuminate in red, and the second set of LEDs 224 may illuminate in blue. A selector switch 216 selects one set of LEDs to be active. As shown in FIG. 2, the first set of LEDs (202) is connected to power source 204. In embodiments, the power source 204 may include one or more batteries. In portable applications, the power source 104 may include one or more small batteries such as AA or AAA sized batteries. In some embodiments, the power source 204 may include one or more coin-style batteries such as a CR2032 or similar battery type. In some embodiments, the power source 204 may be a rechargeable power source. In some embodiments, the power source 204 may be a wired AC or DC power source. A switch 206 may be used to complete the circuit which allows the LEDs that are selected by switch 216 to illuminate. Some embodiments may include a switching arrangement that allows selecting both banks of LEDs to illuminate simultaneously.

In some embodiments, the first set of LEDs 202 and the second set of LEDs 224 may illuminate in the same color. In such embodiments, the selector switch 216 may be used to enable a redundant set of LEDs to provide increased reliability. In the event that one set of LEDs fails, the user can select the other set of LEDs via the selector switch 216.

FIG. 3 is a detailed schematic view of a light module 300 indicating linear interspacing and lateral interspacing. A linear interspacing 323 is a distance between LED 304 and 306. The linear interspacing 323 is the distance between two LEDs that are adjacent to each other in the X direction (indicated by arrow X). A lateral interspacing 325 is a distance between LED 302 and LED 304. The lateral interspacing 325 is the distance between two LEDs adjacent to each other in the Y direction (indicated by arrow Y). LEDs 302 and 304 may, or may not be, part of the same series electrical connection.

In embodiments, the LEDs have an average linear interspacing ranging from 6 millimeters to 20 millimeters and an average lateral interspacing ranging from 6 millimeters to 20 millimeters. The average linear interspacing is an average of the linear interspacing of all the LEDs on a light module. The average lateral interspacing is an average of the lateral interspacing of all the LEDs on a light module. In some embodiments, a light module may have an irregular shape, or have a few LEDs placed on outlying portions of a light module. Those outlying LEDs may have a larger linear and/or lateral interspacing than the majority of the LEDs on the light module.

FIG. 4 is an embodiment 400 of the present invention utilizing a circuit board 402 formed in a circular shape. The circuit board 402 may include multiple layers of insulating material (such as plastic) and metal layers that form conductive traces. Embodiments may include multiple traces. In FIG. 4, two such traces are indicated as 432 and 433. The traces may include contact points. Two contact points, 404 and 406 are shown. Contact points 404 and 406 form a contact pair. Each contact point of a contact pair is electrically connected to a different trace, such that, unless a component or wire is placed across the contact pair, electricity cannot flow between the two contact points of a contact pair. Contact point 404 is electrically connected to trace 432, and contact point 406 is electrically connected to trace 433. In embodiments, an LED is placed across contact point 404 and 406 as part of the manufacturing process. In embodiments, this may be performed using automated equipment such as pick-and-place machines to place the LEDs at the proper location, followed by a soldering process to secure the LEDs in place on the contacts. In FIG. 4, a single LED 408 is shown placed across two corresponding contacts. In practice, multiple LEDs may be placed on the circuit board 402 across the different sets of contact pairs. In some embodiments, wires may be placed across some of the contact pairs in applications where it is not required to populate each contact pair with an LED. In this way, the same circuit board can be used for a variety of lighting applications. When less than the maximum amount of light is needed for a certain application, some of the contact pairs can be populated with wires, or other electrical components such as resistors, capacitors, inductors, and/or diodes, in place of an LED.

In embodiments, the plurality of LEDs ranges from 100 LEDs to 500 LEDs. In some embodiments, the plurality of LEDs ranges from 50 LEDs to 250 LEDs. In some embodiments, the plurality of LEDs ranges from 500 LEDs to 1,000 LEDs.

Circuit board 400 includes mounting holes 410 and 412. While two mounting holes are shown in FIG. 4, in practice, there can be more or fewer mounting holes. The mounting holes can be used to secure the circuit board to another assembly via fasteners such as screws.

FIG. 5 is an additional embodiment 500 of the present invention utilizing a circuit board 502 formed in a circular shape. This embodiment utilizes two series connections in order two support individual control of two sets of LEDs, and schematically is similar to the circuit shown in FIG. 2, having two sets of electrical series connections, enabling two sets of LEDs. This enables a two-color embodiment of the present invention. Contact point 504 and contact point 506 comprise a contact pair for a first series connection. Contact point 514 and contact point 516 comprise a contact pair for a second series connection. Each contact point of a contact pair is electrically connected to a different trace, such that, unless a component or wire is placed across the contact pair, electricity cannot flow between the two contact points of a contact pair. In embodiments, the selection of the first series connection or second series connection may be performed utilizing a selection switch such as indicated at 216 of FIG. 2.

In FIG. 5, a single LED 528 is shown placed across two corresponding contacts. In practice, multiple LEDs may be placed on the circuit board 502 across the different sets of contact pairs. In some embodiments, wires may be placed across some of the contact pairs in applications where it is not required to populate each contact pair with an LED. In this way, the same circuit board can be used for a variety of lighting applications. When less than the maximum amount of light is needed for a certain application, some of the contact pairs can be populated with wires, or other electrical components such as resistors, capacitors, inductors, and/or diodes, in place of an LED.

Circuit board 500 includes multiple mounting holes, indicated generally as 510. While four mounting holes are shown in FIG. 5, in practice, there can be more or fewer mounting holes. The mounting holes can be used to secure the circuit board to another assembly via fasteners such as screws.

FIG. 6 is an embodiment 600 of the present invention utilizing a circuit board 602 formed in a rectangular shape. The circuit board 602 has a length L and a width W. In some embodiments, the circuit board 602 is formed in a square shape, where W equals L. The circuit board 602 includes multiple traces, indicated generally as 632. Two contact points, 604 and 606 are shown. Contact points 604 and 606 form a contact pair. Each contact point of a contact pair is electrically connected to a different trace, such that, unless a component or wire is placed across the contact pair, electricity cannot flow between the two contact points of a contact pair.

In FIG. 6, a single LED 628 is shown placed across two corresponding contacts. In practice, multiple LEDs may be placed on the circuit board 602 across the different sets of contact pairs. In some embodiments, wires may be placed across some of the contact pairs in applications where it is not required to populate each contact pair with an LED. In this way, the same circuit board can be used for a variety of lighting applications. When less than the maximum amount of light is needed for a certain application, some of the contact pairs can be populated with wires, or other electrical components such as resistors, capacitors, inductors, and/or diodes, in place of an LED. Thus, in embodiments, the circuit board is formed in a rectangular shape. In some embodiments, the circuit board is formed in a square shape.

Circuit board 600 includes multiple mounting holes, indicated generally as 610. While four mounting holes are shown in FIG. 6, in practice, there can be more or fewer mounting holes. The mounting holes can be used to secure the circuit board to another assembly via fasteners such as screws FIG. 7 is an additional embodiment 700 of the present invention utilizing a circuit board formed in a rectangular shape. The circuit board 702 has a length L and a width W. In some embodiments, the circuit board 702 is formed in a square shape, where W equals L. The circuit board 702 includes multiple traces, indicated generally as 732. This embodiment utilizes two series connections in order two support individual control of two sets of LEDs, and schematically is similar to the circuit shown in FIG. 2, having two sets of electrical series connections, enabling two sets of LEDs. This enables a two-color embodiment of the present invention. Contact point 704 and contact point 706 comprise a contact pair for a first series connection. Contact point 714 and contact point 716 comprise a contact pair for a second series connection. Each contact point of a contact pair is electrically connected to a different trace, such that, unless a component or wire is placed across the contact pair, electricity cannot flow between the two contact points of a contact pair. In embodiments, the selection of the first series connection or second series connection may be performed utilizing a selection switch such as indicated at 216 of FIG. 2.

In FIG. 7, a single LED 728 is shown placed across two corresponding contacts. In practice, multiple LEDs may be placed on the circuit board 702 across the different sets of contact pairs. In some embodiments, wires may be placed across some of the contact pairs in applications where it is not required to populate each contact pair with an LED. In this way, the same circuit board can be used for a variety of lighting applications. When less than the maximum amount of light is needed for a certain application, some of the contact pairs can be populated with wires, or other electrical components such as resistors, capacitors, inductors, and/or diodes, in place of an LED.

Circuit board 700 includes multiple mounting holes, indicated generally as 710. While four mounting holes are shown in FIG. 7, in practice, there can be more or fewer mounting holes. The mounting holes can be used to secure the circuit board to another assembly via fasteners such as screws.

FIG. 8 shows details of a wire-bonded LED package 800 used in accordance with embodiments of the present invention. Within this disclosure, the term "LED" and "LED package" may be used interchangeably. Wire-bonded LED 800 includes a substrate 802. In embodiments, the substrate 802 is comprised of aluminum oxide. In embodiments, the substrate 802 may be comprised of other oxides or suitable materials. A dielectric layer 804 is disposed over the substrate 802. In embodiments, the dielectric layer 804 is comprised of silicon oxide, silicon nitride, titanium oxide, zirconium oxide, or other suitable material.

In embodiments, each LED of the plurality of LEDs comprises a wire-bonded LED. In embodiments, each wire-bonded LED of the plurality of LEDs is disposed on a substrate that comprises aluminum oxide. A first electrode 806 and a second electrode 816 are disposed on the dielectric layer 804. In embodiments, the electrodes 806 and 816 are comprised of a conductive material comprising copper, gold, or other suitable conductive material. A thermal conductive adhesive 822 is disposed on the dielectric layer 804. An LED chip 824 is disposed on the thermal conductive adhesive 822. The LED chip 824 comprises a first contact 808 and a second contact 818. The first contact 808 and the second contact 818 may be comprised of a conductive material comprising copper, gold, or other suitable conductive material. A first wire 810 provides an electrical connection between contact 806 and contact 808. A second wire 820 provides an electrical connection between contact 816 and contact 818. In embodiments, wires 810 and 820 are comprised of gold, copper, or other suitable conductive material. In embodiments, the wires are placed using an automated wire-bonding machine. In embodiments, the LEDs indicated in FIGS. 1-7 may be similar to LED 800 shown in FIG. 8.

FIG. 9 shows details of a flip chip LED package 900 used in accordance with embodiments of the present invention. Within this disclosure, the term "LED" and "LED package" may be used interchangeably. Flip-chip LED 900 includes a substrate 902. In embodiments, the substrate 902 is comprised of aluminum oxide. In embodiments, the substrate 902 may be comprised of other oxides or suitable materials. A dielectric layer 904 is disposed over the substrate 902. In embodiments, the dielectric layer 904 is comprised of silicon oxide, silicon nitride, titanium oxide, zirconium oxide, or other suitable material.

A first electrode 906 and a second electrode 916 are disposed on the dielectric layer 904. In embodiments, the electrodes 906 and 916 are comprised of a conductive material comprising copper, gold, or other suitable conductive material. A solder paste layer 908 is disposed on contact 906. A solder paste layer 918 is disposed on electrode (contact) 916. An LED flip chip 922 has a first electrode (contact) 910 and a second electrode (contact) 920. The contacts 910 and 920 of the flip chip LED are disposed on the solder paste layers 908 and 918. This forms an electrical connection between electrode 906 and electrode 910. A similar electrical connection is formed between electrode 916 and electrode 920. The first electrode 906 and the second electrode 916 may be comprised of a conductive material comprising copper, gold, or other suitable conductive material. In embodiments, electrodes 910 and 920 are also comprised of gold, copper, or other suitable conductive material. In embodiments, the LEDs indicated in FIGS. 1-7 may be similar to LED 900 shown in FIG. 9. In embodiments, each LED of the plurality of LEDs comprises a flip chip LED. In embodiments, each flip chip LED of the plurality of LEDs is disposed on a substrate that comprises aluminum oxide.

FIG. 10 shows an exemplary circuit 1000 for a dual-color light module in accordance with embodiments of the present invention. Circuit 1000 includes a light module 1044. In embodiments, light module 1044 may be similar to embodiment 700 shown in FIG. 7. Circuit 1000 includes a power source 1004. In embodiments, the power source 1004 may include one or more batteries. In portable applications, the power source 1004 may include one or more small batteries such as AA or AAA sized batteries. In some embodiments, the power source 1004 may include one or more coin-style batteries such as a CR2032 or similar battery type. In some embodiments, the power source 1004 may be a rechargeable power source. In some embodiments, the power source 1004 may be a wired AC or DC power source. A switch 1006 may be used to complete the circuit which allows the LEDs to illuminate. Selector switch 1014 electrically connects a first power lead 1026 or a second power lead 1024 to the power source 1004. This allows selection of a first illumination color or a second illumination color. Some embodiments may include illumination of both sets of LEDs simultaneously.

Embodiments include a light module having a first power lead configured and disposed as a positive power source connection, and; a second power lead configured and disposed as a negative power source connection; wherein the LEDs have an average linear interspacing ranging from 6 millimeters to 20 millimeters and an average lateral interspacing ranging from 6 millimeters to 20 millimeters; a power source coupled to the light module; and a switch configured and disposed to connect the light module to the power source.

FIG. 11 shows an exemplary microprocessor-controlled circuit 1100 for a dual-color light module in accordance with embodiments of the present invention. Circuit 1100 includes a light module 1144. In embodiments, light module 1144 may be similar to embodiment 700 shown in FIG. 7. Circuit 1100 includes a power source 1104. In embodiments, the power source 1104 may include one or more batteries. In portable applications, the power source 1004 may include one or more small batteries such as AA or AAA sized batteries. In some embodiments, the power source 1104 may include one or more coin-style batteries such as a CR2032 or similar battery type. In some embodiments, the power source 1104 may be a rechargeable power source. In this embodiment, a microcontroller 1112 is used for control of the light module 1144. The microcontroller may include an on-board non-transitory computer-readable medium 1114. In embodiments, the computer-readable medium 1114 may include flash, SRAM, or other suitable hardware storage device. The microcontroller is configured and disposed to control a switch 1157 via a GPIO (General Purpose Input/Output) line. The switch 1157 is configured and disposed to provide power to a first power lead 1126 and/or a second power lead 1124 to illuminate a first set of LEDs, a second set of LEDs, or both the first and second sets of LEDs simultaneously. A user interface 1146 is coupled to the microcontroller 1112. In embodiments, the user interface 1146 is connected to one or more GPIO lines of the microcontroller 1112. The user interface 1146 may include a switch, button, knob, or other suitable user interface. Through the user interface, the user may control operation of the LEDs within light module 1144. The operation can include illumination, correlated color temperature (CCT) settings, blink patterns, and/or other modes of operation.

Circuit 1100 may optionally include a sensor array 1132. The sensor array 1132 may include one or more environmental sensors, such as ambient light sensor 1134, and/or sound sensor 1136. In embodiments, the microcontroller 1112 may receive input from the sensor array 1132, and operate the LEDs within light module 1144 based on the received input. Example applications include auto-shut-off to shut off the LEDs when ambient light, as detected by the light sensor 1134 exceeds a predetermined threshold. Another application is to blink the LEDs based on sound input received from the sound sensor 1136. An example application is to blink LEDs in response to ambient sounds such as the beats of dance music.

Circuit 1100 may optionally include a communication interface 1159. The communication interface 1159 may include a Bluetooth® transceiver, or other suitable wireless communication device to allow communication with a remote computing device 1171. Remote computing device 1171 may include a mobile electronic device such as a tablet computer, smartphone, smart watch, or other suitable electronic device. The remote computing device 1171 may include a touchscreen. The remote computing device 1171 may be configured and disposed to connect, pair, or otherwise control the light module 1144 via the communication interface 1159. A user interface on the remote computing device 1171 may allow turning on or off the LED module 1144, setting blink patterns, adjusting the output correlated color temperature (CCT), setting actions based on input from the sensor array 1132, and/or other user actions.

Embodiments can include a microcontroller, wherein the microcontroller comprises a non-transitory computer-readable medium containing instructions, that when executed by the microcontroller, operate the plurality of light emitting diodes (LEDs). Embodiments can include a microcontroller, and a sensor array, wherein the microcontroller comprises a non-transitory computer-readable medium containing instructions, that when executed by the microcontroller, operate the plurality of light emitting diodes (LEDs) based on detected input of the sensor array. In embodiments, the sensor array comprises a light sensor. In embodiments, the sensor array comprises a sound sensor.

FIG. 12 shows an LED light fixture in accordance with embodiments of the present invention. Light fixture 1200 comprises an enclosure 1202. Within the enclosure 1202, a light module 1244 is disposed. In embodiments, light module 1244 may be similar to light module 600 of FIG. 6 or light module 700 of FIG. 7. Light control circuit 1207 may be similar to circuit 1000 of FIG. 10, or circuit 1100 of FIG. 11. The light control circuit 1207 is electrically coupled to the light module 1244. A power cable 1204 is electrically connected to the electrical connector 1247 of the light module 1244 and/or light control circuit 1207. In embodiments, the light control circuit 1207 may include circuitry such as an AC-to-DC driver, triacs, thyristors, and/or other associated circuitry in order to produce light from the light module 1244. In embodiments, a DC (direct current) converter (not shown) may convert household AC (alternating current) to DC current in order to properly provide power via cable 1204 to the light module 1244. A plurality of fasteners 1230 may be used to suspend the light fixture 1200 from a ceiling 1228. Each fastener may include a post 1222 affixed to a top surface 1217 of the enclosure 1202. Disposed on one end of post 1222 is a coil spring 1224. A flange 1226 is attached to the spring. The force of the spring 1224 urges the flange 1226 against the upper surface 1229 of the ceiling 1228, keeping the light fixture 1200 in place in a recessed, or partially recessed manner within the ceiling 1228. The bottom surface 1205 of the enclosure 1200 is preferably translucent or transparent, to allow light from the light module 1224 to illuminate an interior (e.g. a room of a building or structure).

FIG. 13 shows installation of an LED light fixture in accordance with embodiments of the present invention. In embodiments, the power cable 1204 is connected to the electrical connector 1247 of the light fixture 1200. Then one flange, indicated as 1226, is positioned on the top surface 1229 of ceiling 1228 through recess 1255. The flange 1226' of the other fastener 1230 is pushed upward in order to clear the ceiling 1228. Once cleared, the spring 1224' urges the flange 1226' downward, holding the light fixture in place as depicted in FIG. 12.

FIG. 14 shows removal of an LED light fixture in accordance with embodiments of the present invention. In embodiments, when the enclosure 1202 is pulled downward, in the direction indicated by arrow 1261, the flanges 1226 of each fastener 1230 flex upwards to allow removal of the enclosure 1202 from the ceiling 1228. The power cable 1204 can then be disconnected to completely remove the light fixture 1200.

FIG. 15A shows a side view of an additional embodiment of the present invention. FIG. 15B shows a bottom-up view of the embodiment of FIG. 15A as viewed from the direction indicated by arrow 1292. Light fixture 1200 comprises an enclosure 1202. Within the enclosure 1202, a light module 1244 is disposed. Light control circuit 1207 may be similar to circuit 1000 of FIG. 10, or circuit 1100 of FIG. 11. The light control circuit 1207 is electrically coupled to the light module 1244. A power cable 1204 is electrically connected to the electrical connector 1247 of the light module 1244 and/or light control circuit 1207. In embodiments, the light control circuit 1207 may include circuitry such as an AC-to-DC driver, triacs, thyristors, and/or other associated circuitry in order to produce light from the light module 1244. Affixed to the enclosure is a frameless cover 1291. The frameless cover 1291 is preferably comprised of translucent material. The cover 1291 preferably has a flat lower surface 1293. That is, the lower surface 1293 is planar, having substantially no curvature, thus being a flat surface. Referring again to FIG. 15B, the frameless (rimless) cover 1291 has a diameter indicated as 1284. In embodiments, the diameter 1284 may range from 3 inches to 12 inches.

Through the optimized distance design from the lower surface of the cover to the light-emitting surface, when the distance between the light module 1244 and the lower surface 1293, which is indicated by arrow 1295, is greater than a predetermined threshold, the frameless cover achieves the effect of uniform light emission. In some embodiments, the distance from the lower surface of the cover to the light-emitting surface (LEDs) is a distance that is within the range from two centimeters to four centimeters. Thus, embodiments can include a cover affixed to the enclosure, wherein the cover comprises a planar lower surface, and wherein a distance between the plurality of LEDs and the planar lower surface is between two centimeters and four centimeters.

Embodiments may optionally include a correlated color temperature (CCT) control switch 1307. In embodiments, the light module 1244 may include monochromatic temperature dimming, or 3CCT/4CCT/5CCT color temperature dimming. In embodiments combined with constant power applications, it can be 5CCT+DB dimming. In embodiments, the color temperature function is selected by a DIP switch. The position of the CCT control switch can be on the output line, or can be on the drive box or affixed to the light fixture, as indicated at 1307 of FIG. 15A.

In some embodiments, the CCT control switch allows for a first CCT and a second CCT. In some embodiments, a combined-light CCT may be provided as well. The first CCT might be in the range 4000K to 7000K. The second CCT might be in the range 1500K to 3000K. The combined-light CCT might be: in the range 4500K to 6500K at a top of the upper range, in the range 2500K to 3500K at a bottom of the upper range and the top of the lower range, and in the range 1500K to 2500K at a bottom of the lower range.

FIG. 16 shows an exploded view of a rimless round LED light fixture 1600 in accordance with additional embodiments of the present invention. Fixture 1600 includes an adapter ring 1604 which may be installed with a drop ceiling of an interior space such as room, hallway, closet, etc. In embodiments, the adapter ring is comprised of a metal such as stainless steel, aluminum, or other suitable material. Fixture 1600 further includes a light source housing 1608 which is an enclosure that provides a mechanical connection for circular LED circuit board 1610. In embodiments, one or more threaded fasteners, indicated generally as 1614, are used to affix the circular LED circuit board 1610 to the light source housing 1608. Light source housing 1608 comprises an opening 1609 therein to allow placement of conduits such as wires or a wiring harness to provide power to the circuit board 1610. Light source housing 1608 further comprises a plurality of clips, indicated generally as 1606, to secure the light source housing 1608 to the adapter ring 1604. In some embodiments, the clips 1606 are spring-loaded clips. In embodiments, circuit board 1610 may be similar to reference 400 of FIG. 4 or reference 500 of FIG. 5. A rimless round cover 1612 may be installed over the light source housing 1608. In embodiments, the cover 1612 may be affixed to the light source housing 1608 via adhesive, friction fit, fasteners, or other suitable mechanism. The cover 1612 is preferably comprised of a clear or translucent material such as glass or plastic. Light fixture 1600 is termed as "rimless" as there is no metal or plastic band present around the perimeter of the cover 1612. The rimless cover 1612 enables more light to be distributed throughout an area as compared with other prior art devices. Embodiments may include a variety of sizes for cover 1612, including, but not limited to, a 3-inch diameter, 4-inch diameter, 6-inch diameter, 8-inch diameter, and 12-inch diameter.

FIG. 17 shows an exploded view of a rimless rectangular LED light fixture 1700 in accordance with additional embodiments of the present invention. In some embodiments, the rectangular LED light fixture 1700 may have a square shape. Fixture 1700 includes an adapter ring 1704 which may be installed with a drop ceiling of an interior space such as room, hallway, closet, etc. In embodiments, the adapter ring is comprised of a metal such as stainless steel, aluminum, or other suitable material. Fixture 1700 further includes a light source housing 1708 which is an enclosure that provides a mechanical connection for rectangular LED circuit board 1710. In embodiments, one or more threaded fasteners, indicated generally as 1714, are used to affix the rectangular LED circuit board 1710 to the light source housing 1708. Light source housing 1708 comprises an opening 1709 therein to allow placement of conduits such as wires or a wiring harness to provide power to the circuit board 1710. Light source housing 1708 further comprises a plurality of clips, indicated generally as 1706, to secure the light source housing 1708 to the adapter ring 1704. In some embodiments, the clips 1706 are spring-loaded clips. In embodiments, circuit board 1710 may be similar to reference 600 of FIG. 6 or reference 700 of FIG. 7. A rimless rectangular cover 1712 may be installed over the light source housing 1708. In embodiments, the cover 1712 may be affixed to the light source housing 1708 via adhesive, friction fit, fasteners, or other suitable mechanism. The cover 1712 is preferably comprised of a clear or translucent material such as glass or plastic. Light fixture 1700 is termed as "rimless" as there is no metal or plastic band present around the perimeter of the cover 1712. The rimless cover 1712 enables more light to be distributed throughout an area as compared with other prior art devices. Embodiments may include a variety of sizes for cover 1712, including, but not limited to, a 3-inch square, 4-inch square, 6-inch square, 8-inch square, and 12-inch square.

As can now be appreciated, disclosed embodiments provide an improved LED light module. Embodiments can utilize face-up wire-bonded LED packages. Embodiments can also use flip chip LED packages. Flip chip LEDs provide various advantages including reduced size, larger illumination angle, improved thermal conductivity, easier optical design, reduced LES (LED emitting surface), and less manufacturing costs. Thus, these embodiments are feasible for portable and mobile lighting applications, as well as in residential lighting applications, enabling improved lighting and safety with reduced weight, power consumption, and cost. Embodiments can further include a rimless light cover to further increase the amount of light emanating from the light fixture.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A light fixture comprising a light module, the light module comprising:

a plurality of light emitting diodes (LEDs) arranged in a first series connection on a circuit board;

a light source housing, configured and disposed to contain the circuit board;

wherein the LEDs are positioned on the circuit board to have an average linear interspacing ranging from 1 millimeter to 4 millimeters and an average lateral interspacing ranging from 6 millimeters to 20 millimeters;

a plurality of clips disposed on the light source housing;

an adapter ring, configured and disposed to engage the plurality of clips;

a rimless cover, configured and disposed to attach to the light source housing; and a correlated color temperature (CCT) control switch affixed to the light fixture, wherein the CCT control switch is configured and disposed to cause the LEDs to output a CCT with a lower range limit of 1500K.

2. The light fixture of claim 1, wherein the rimless cover is comprised of plastic.

3. The light fixture of claim 1, wherein the rimless cover is comprised of glass.

4. The light fixture of claim 1, wherein the rimless cover is round.

5. The light fixture of claim 1, wherein the rimless cover is rectangular.

6. The light fixture of claim 5, wherein the rimless cover is square.

7. The light fixture of claim 1, wherein the plurality of clips comprises two clips.

8. The light fixture of claim 1, wherein each LED of the plurality of LEDs comprises a wire-bonded LED.

9. The light fixture of claim 1, wherein each LED of the plurality of LEDs comprises a flip chip LED.

10. The light fixture of claim 1, wherein each LED of the plurality of LEDs is disposed on a substrate that comprises aluminum oxide.

11. The light fixture of claim 1, wherein the plurality of LEDs includes a first subset of LEDs corresponding to a first series connection, and configured and disposed to illuminate in a first color, and a second subset of LEDs corresponding to a second series connection, and configured and disposed to illuminate in a second color.

12. An illumination system comprising:

an enclosure;

a light module disposed within the enclosure, the light module comprising:

a plurality of light emitting diodes (LEDs) arranged in a first series connection on a circuit board;

a first power lead configured and disposed as a positive power source connection, and;

a second power lead configured and disposed as a negative power source connection; wherein the LEDs are positioned on the circuit board to have an average linear interspacing ranging from 1 millimeter to 4 millimeters and an average lateral interspacing ranging from 6 millimeters to 20 millimeters;

a power source coupled to the light module;

a switch configured and disposed to connect the light module to the power source;

a rimless cover, configured and disposed to attach to the enclosure and a correlated color temperature (CCT) control switch affixed to the enclosure, wherein the CCT control switch is configured and disposed to cause the LEDs to output a CCT with a lower range limit of 1500K.

13. The illumination system of claim 12, wherein the plurality of LEDs includes a first subset of LEDs corresponding to a first series connection, and configured and disposed to illuminate in a first color, and a second subset of LEDs corresponding to a second series connection, and configured and disposed to illuminate in a second color.

14. The illumination system of claim 12, wherein the circuit board is formed in a rectangular shape.

15. The illumination system of claim 12, wherein the circuit board is formed in a circular shape.

16. The illumination system of claim 12, wherein the rimless cover is comprised of plastic.

17. The illumination system of claim 12, wherein the rimless cover is comprised of glass.

18. The illumination system of claim 12, wherein the rimless cover is round.

19. The illumination system of claim 12, wherein the rimless cover is square.

* * * * *